United States Patent [19]

Farrington et al.

[11] 4,334,956

[45] Jun. 15, 1982

[54] METHOD OF REUTILIZING KRAFT SPENT LIQUOR

[75] Inventors: Alan Farrington, Donvale; Peter F. Nelson, Kew, both of Australia

[73] Assignee: Australian Paper Manufacturers Limited, South Melbourne, Australia

[21] Appl. No.: 208,662

[22] Filed: Nov. 20, 1980

[51] Int. Cl.[3] ..... D21C 11/02; D21C 11/04

[52] U.S. Cl. ..... 162/30.11; 162/33; 162/35; 162/36; 162/38; 210/763; 210/928; 423/207; 423/DIG. 3

[58] Field of Search ..... 162/30 R, 30 K, 31, 162/35, 51, 33, 34, 38, 30.11, 30.1; 423/206 R, 207, DIG. 3; 210/758, 763, 928

[56] References Cited

U.S. PATENT DOCUMENTS 4,053,352 10/1977 Hultman et al. ..... 162/30 K 4,073,678 2/1978 Hammond et al. ..... 162/35

4,098,639 7/1978 Noreus et al. ..... 210/928

FOREIGN PATENT DOCUMENTS 50-88703 1/1975 Japan ..... 162/31

488792 6/1973 U.S.S.R. ..... 210/763

*Primary Examiner*—Steve Alvo

*Attorney, Agent, or Firm*—Bucknam and Archer

[57] ABSTRACT

A method of utilizing kraft black liquor by converting the black liquor to "green liquor" and then oxidizing the green liquor with air in the presence of a quinone compound or spent liquor from the kraft process, the soda semi-chemical process or the neutral sulfite semi-chemical process as a catalyst. A marked improvement in the rate of oxidation is obtained. The thus oxidized green liquor is then able to be used as part at least of the digestion liquor in the NSSC process.

6 Claims, 2 Drawing Figures

METHOD OF REUTILIZING KRAFT SPENT LIQUOR

DESCRIPTION OF INVENTION

Figure 1:
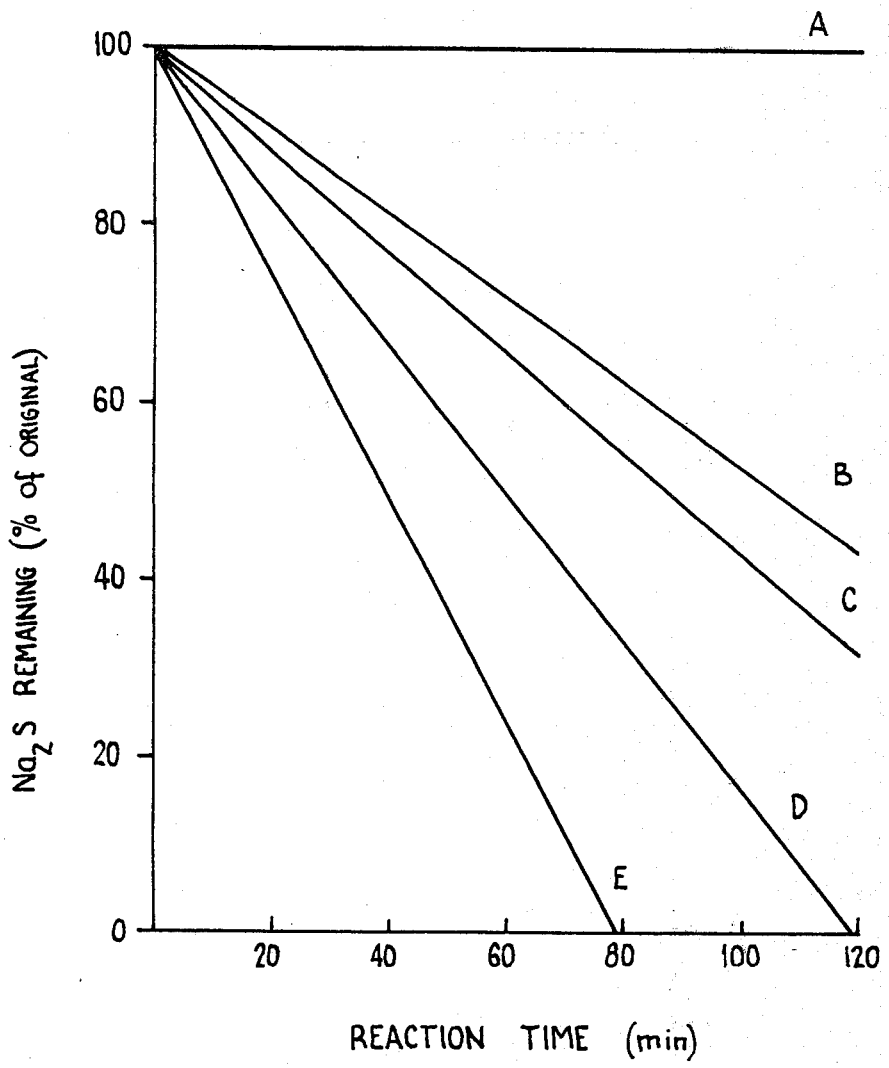

This invention relates to an improvement in the recovery and use of chemicals used in the manufacture of paper pulp by the kraft process and the neutral sulphite semichemical (NSSC) pulping process.

The Kraft process for production of paper pulp from wood and other lignocellulosic materials involves digestion of the latter with an aqueous solution of sodium hydroxide and sodium sulphide. It includes a chemical recovery stage in which the spent liquor ("black liquor") containing dissolved organic substances from the lignocellulosic together with inorganic pulping chemicals is concentrated and burned in a furnace. In this way the heat equivalent of the organic substances, which represent about half the weight of the lignocellulosic raw material, is recovered in the form of steam and the inorganic chemicals recovered as a smelt. The latter, which consists essentially of a mixture of sodium carbonate and sodium sulphide is dissolved in water to form "green liquor" and then treated with slaked lime to re-form the pulping chemicals, viz. sodium hydroxide and sodium sulphide (white liquor). The latter chemicals are thus continuously recycled in what is, theoretically, a closed system. In practice there are always losses from such a system and it is necessary to make these good by addition of chemicals containing sodium and sulphur, the most common such chemical being sodium sulphate or 'salt-cake'.

Pulping installations producing pulp for the manufacture of container materials, e.g. corrugated boxes, often comprise, besides a kraft mill, a neutral sulphite semichemical (NSSC) mill to produce high yield pulp suitable for making corrugating medium and perhaps for inclusion as a component of the liner. Processes available for recovery of the pulping chemicals from the NSSC process are complex and expensive and it is common practice to use the spent liquor from the NSSC process as 'make-up' for the kraft mill to make good the losses in the latter.

This process is satisfactory where the kraft and NSSC mills are 'matched' so that the amount of chemical loss from the former is similar to the chemical content of the spent liquor available from the latter. This could be the case if the pulp output from the kraft mill was much greater than that from the NSSC mill (e.g. by a factor of about three) or if the losses from a relatively smaller kraft mill were abnormally high. It is common, however, for a disparity to exist between the two mills, especially in view of the more stringent anti-pollution requirements which have affected kraft mills in recent years, greatly reducing the losses of both sodium and sulphur from such mills. It is commonly found that the inorganic chemical content of the NSSC spent liquor exceeds that required as make-up in the kraft mill by a considerable margin. Under such conditions the total stock or inventory of sodium and sulphur in the kraft system will increase to the point where chemicals must be extracted from the system and either sold or dumped.

Dumping of such chemicals is difficult because of their adverse environmental impact. Sale is also frequently difficult as there is little demand for the kind of chemicals which can be produced in this way.

In Australian Pat. No. 473,185, it was proposed to oxidize kraft white liquor using kraft black liquor as a catalyst and then using the kraft white liquor in gas purification, oxygen pulp bleaching, regeneration of ion exchangers among other uses.

Another alternative which has been considered is to re-cycle the kraft mill chemicals, at least in part, to the NSSC mill, thus reducing the amount of fresh chemicals entering the kraft-NSSC system as a whole. This can be done, for instance, by extracting green liquor from the kraft recovery circuit prior to causticization and using the green liquor as chemical for the NSSC mill. Green liquor is an aqueous solution of sodium carbonate and sodium sulphide, commonly in the approximate ratio of 4 to 1, and in theory it can replace part or all of the sodium carbonate used in neutral sulphite pulping. In the preparation of cooking chemical for the latter, a sodium carbonate solution is treated with sulphur dioxide ('sulphitation') to form sodium sulphite but the treatment is normally discontinued after ca 75–95% of the carbonate has been converted to sulphite. The remaining 5 to 25% of carbonate serves as the so-called 'buffer' to neutralize wood-derived acids in the early stages of pulping. Green liquor can serve either as 'buffer' by mixing it with a sodium sulphite solution formed by complete sulphitation of a sodium carbonate solution or it can be used to replace the sodium carbonate solution before sulphitation, i.e. to provide the whole of the sodium for the NSSC mill.

Whichever way the green liquor is used it creates serious environmental problems. If used as 'buffer' it generates toxic and foul-smelling hydrogen sulphide gas at the near-neutral pH normally encountered in NSSC pulping. If used for sulphitation, hydrogen sulphide is expelled by the action of the sulphur dioxide. In both cases the consequences are environmentally inacceptable.

These problems can be overcome by oxidation of the green liquor to convert the sodium sulphide to sodium thiosulphate, (normally the main product), sodium sulphite and sodium sulphate, none of which evolve hydrogen sulphide under the conditions normally used for NSSC pulping or for sulphitation. The oxidation of green liquor can be carried out using oxygen gas or air. When air is used the oxidation is rather slow and it is difficult to achieve complete destruction of sulphide in a reasonable time without using elevated temperatures that require a pressure vessel.

Thus, in order to effectively use up the spent chemicals of the kraft process it is necessary to devise a method of using them or converting them to a form which does not result in the generation of $H_2S$ and which method can be carried out economically.

This invention provides such a method, the said method comprising recovering from the kraft process, spent black liquor; converting the kraft black liquor to green liquor; oxidizing the green liquor in the presence of an oxygen containing gas and an effective amount of at least one additive selected from the group consisting of a quinone or hydroquinone compound, spent kraft black liquor, spent NSSC black liquor and spent black liquor from a semi chemical soda process; and utilizing the thus oxidized green liquor in a neutral sulphite semichemical (NSSC) pulping process.

The oxidation of the green liquor according to this invention is remarkably accelerated compared to air oxidation alone. The oxygen containing gas is preferably air and the reaction is carried out within a preferred temperature range of 50° to 150° C.

By the means of this invention the sulphide can be completely destroyed in a relatively short time at atmospheric pressure and moderate temperature, without the need for a pressure vessel.

The spent delignification liquors preferred as catalytic additives to the green liquor are spent kraft pulping liquor (black liquor), spent soda liquor from the soda semi-chemical pulping process, or NSSC spent liquor with the latter being preferred. The quinone compounds which may also be used are preferably anthraquinone or anthraquinone monosulfonate.

The spent liquors may already include quinone compounds if these have been added to the delignification liquors to accelerate the delignification process in either the kraft, soda or NSSC process. Preferably 1 to 15% more preferably 3 to 10% by weight of the spent liquors is added to the green liquor. The quinone compounds are preferably used in amounts of 0.1% to 10% by weight.

In order to illustrate the advantage of the present invention the oxidation by air of the green liquor was compared to the oxidation in the presence of the catalytic additives of this invention.

Table 1 and FIG. 1 provide comparative results in the use of NSSC spent liquor (line E), anthraquinone monosulphonate (AMS) (line D), soda black liquor which includes anthraquinone (line C), kraft black liquor (line B), compared to the absence of additive (line A).

These results show that the use of NSSC spent liquor results in a complete sulphide removal in about half the time required for kraft black liquor but all the additives (lines B to E) show a vast improvement in reaction time compared to air oxidation alone.

All tests were done in a reactor comprising a glass tube 1 meter in length and 80 millimeters inner diameter, and containing four 10 millimeter stainless steel baffles. Air entered the bottom of the reactor through a 5 millimeter glass tube placed directly under the centre of a stainless steel turbine type stirrer. The entire reactor was placed in a water bath maintained at 80° C. Green liquor (1.5 liter) was charged to the reactor and the air flow rate maintained at 1 liter per minute with a stirrer speed of 2100 revolutions per minute. The sodium sulphite level in gram per liter was determined at various stages throughout the oxidation.

TABLE 1

| Catalyst (% of total liquor) | Time at 80° C. (m) | $Na_2S$ (% of original) |
|---|---|---|
| | 0 | 100.0 |
| | 20 | 99.9 |
| | 40 | 99.6 |
| | 80 | 99.2 |
| 9% NSSC spent liquor | 0 | 100.0 |
| | 20 | 74.0 |
| | 40 | 48.0 |

TABLE 1-continued

| Catalyst (% of total liquor) | Time at 80° C. (m) | $Na_2S$ (% of original) |
|---|---|---|
| | 80 | 0 |
| 0.05% anthraquinone monosulphonate (AMS) | 0 | 100.0 |
| | 20 | 82.8 |
| | 40 | 65.5 |
| | 80 | 31.0 |
| | 120 | 0 |
| 9% soda-AQ black liquor | 0 | 100.0 |
| | 20 | 85.0 |
| | 40 | 75.0 |
| | 80 | 56.0 |
| | 200 | 0 |
| 9% kraft black liquor | 0 | 100.0 |
| | 20 | 91.0 |
| | 40 | 81.0 |
| | 80 | 62.0 |
| | 200 | 9 |

Table 1 and FIG. 1 show that in the absence of any additive, oxidation is extremely slow under the very moderate conditions used, viz. ca 80° and atmospheric pressure. This is so even when high flow rates of air are used. In the absence of NSSC spent liquor, complete oxidation would probably require many days reaction time. Green liquor dregs had only a minor effect in accelerating the rate of oxidation.

Figure 2:
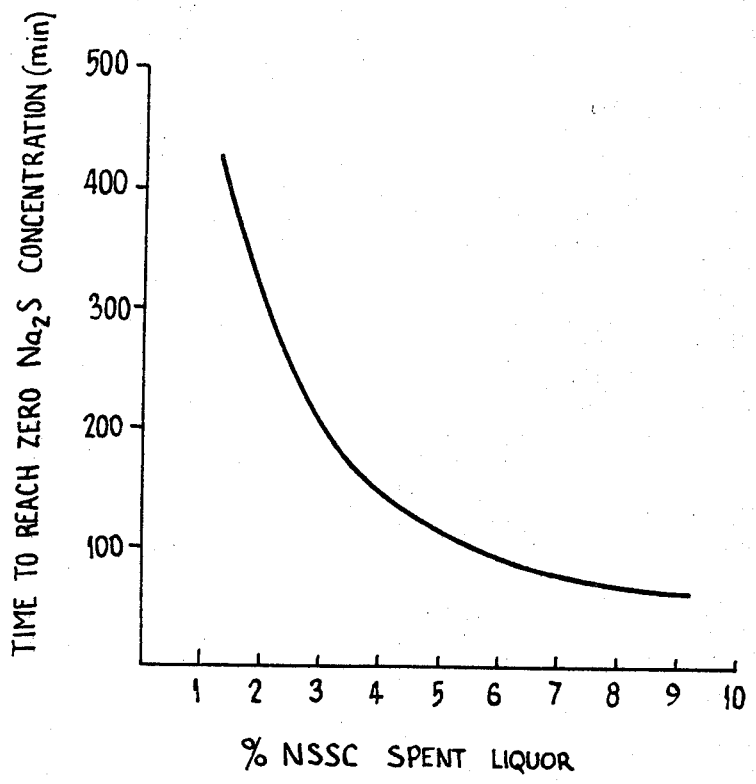

The effect of varying concentrations of NSSC liquor to achieve complete removal of sulphides is shown in FIG. 2 where the vertical axis represents time in minutes to complete oxidation of $Na_2S$ and the horizontal axis represents the % concentration of NSSC black liquor. Thus a 4% concentration of NSSC spent liquor is as effective as a 9% concentration of kraft black liquor.

The reason for the accelerating effect of NSSC spent liquor is unknown but it is thought that it may lie partly in the surfactant properties of the liquor, containing as it does, lignosulphonates. However, commercial anionic surfactants such as "Comprox" or "Teepol" are ineffective in accelerating oxidation and it is likely that other properties of the spent liquor besides surface activity are responsible. It is known that lignin becomes partially demethoxylated during NSSC pulping, with the consequent formation of catechol type groupings. It is hypothesized that these groups are active in accelerating or catalysing the oxidation of sulphide, possibly via a peroxide type intermediate. This mechanism would also explain the effectiveness of quinone compounds or other spent pulping liquors.

The effectiveness of using oxidized kraft green liquor in NSSC pulping as a buffer or as the total chemical liquor is shown in Table 2. The sulphited oxidized green liquor is sulphited to form an NSSC pulping liquor equivalent.

TABLE 2

| | NSSC PULPING EXAMPLES | | | | | | | |
|---|---|---|---|---|---|---|---|---|
| Wood | Ash | | | Mixed hardwood species | | | | |
| Example | 1 | 2 | 3 | 4 | 5 | 6 | 7 | 8 |
| Cooking chemical %$Na_2SO_3$ on OD wood | 15 | 15 | 15 | 9.8 | 9.8 | 9.8 | 9.8 | 9.8 |
| $NaHCO_3$ (% as buffer | 7 | 7 | 20 | 15 | 15 | 30 | 15 | 15 |
| Code (a) | A | B | B | A | B | B | C | C |
| Cooking temp. (°C.) | 175 | 175 | 175 | 170 | 170 | 170 | 170 | 170 |
| Time at temp. | | | | | | | | |

TABLE 2-continued

| | NSSC PULPING EXAMPLES | | | | | | | |
|---|---|---|---|---|---|---|---|---|
| Wood | Ash | | | Mixed hardwood species | | | | |
| Example | 1 | 2 | 3 | 4 | 5 | 6 | 7 | 8 |
| (h) | 2 | 2 | 2 | 1 | 1 | 1 | 1 | 1.5 |
| Yield (% od./ od.) | 69.8 | 69.8 | 69.1 | 73.5 | 71.9 | 73.1 | 70.6 | 69.5 |
| Kappa number | 95 | 99 | 93 | 138 | 136 | 141 | 141 | 136 |
| Spent liquor pH | 6.8 | 6.7 | 7.8 | 6.4 | 6.3 | 7.0 | 6.4 | 6.3 |
| Colour | 60 | 58 | 50 | 42 | 43 | 40 | 41 | 38 |
| Burst index ($kPa.m^3/g$) | 5.9 | 5.9 | 6.4 | 3.9 | 3.6 | 4.0 | 4.1 | 4.3 |
| Breaking length (km) | 9.7 | 9.8 | 10.3 | 6.3 | 6.4 | 7.1 | 7.2 | 7.0 |
| Concora crush (N) | — | — | — | 355 | 340 | 365 | 370 | 370 |

Note (a) -
A : control with laboratory chemicals
B : oxidized green liquor as buffer
C : sulphited oxidized green liquor as total chemical The results given in Table 2 indicate clearly that oxidized green liquor can be successively used as a total replacement for buffer in NSSC pulping without significantly affecting pulp quality (example 2 compared with example 1 and example 5 compared with example 4). For pulping with mixed hardwood species an increase in buffer content from 15 to 30% had no significant effect on pulp colour or strengths except for breaking length which was marginally improved (example 6 compared with examples 4 and 5). Furthermore, with mixed hardwood species, "sulphited" oxidized green liquor can be used as the total chemical replacement with no detrimental effect on pulp strengths or colour (examples 7 and 8 compared with examples 4 and 5).

From the above it can be seen that the present invention enables spent liquors from delignification processes to be usefully employed to avoid waste of the spent liquors and to provide recovery and recycling of excess kraft green liquor for oxidation and use in NSSC pulping. In this way the regeneration of kraft black liquor is a simple and convenient method and provides a product that can find use in an associated pulping process. Compared to the method of U.S. Pat. No. 473,185, the present invention is more convenient as it does away with the need to convert green liquor to white liquor prior to oxidation and furthermore, the oxidized product of this invention can be used as an NSSC pulping liquor which is a product in greater demand than oxidized white liquors. A further advance provided by this invention is that spent liquors from other pulping processes or quinone compounds are more active than kraft liquor in oxidation of $Na_2S$ containing solutions.

We claim:

1. A method of reutilizing kraft process spent black liquor which consists of recovering from the kraft process, spent black liquor; converting the kraft black liquor to green liquor; oxidizing the green liquor, which contains sodium sulfide, with an oxygen containing gas and an effective amount of an additive consisting of spent neutral sulphite semi chemical (NSSC) black liquor to convert said green liquor sodium sulfide to sodium thiosulphate; and utilizing the thus oxidized green liquor as part of the digesting liquor in a neutral sulphite semi chemical (NSSC) pulping process.

2. A method as claimed in claim 1 in which the additive is 1 to 15% by weight of, neutral sulphite semi-chemical black liquor.

3. A method as claimed in claim 2 in which 3 to 10% by weight of said additive is used.

4. A method as claimed in claim 1 in which said additive contains 0.01 to 10% by weight of anthraquinone or anthraquinone monosulphonate.

5. A method as claimed in claim 3 in which the oxidation is carried out at atmospheric pressure in the presence of air and within the temperature range of 50° to 150° C.

6. A method of pulping lignocellulosic material which consists of carrying out pulping of lignocellulosic material by both the kraft process and the neutral sulfite semi-chemical (NSSC) process converting the black liquor from the kraft process into green liquor, which contains sodium sulfide, oxidizing said green liquor with an oxygen containing gas in the presence of an effective amount of the spent liquor from said neutral sulfite semi-chemical (NSSC) process to convert said green liquor sodium sulfide to sodium thiosulphate and adding said oxidized green liquor to the pulping liquor of the neutral sulfite semi-chemical (NSSC) process.

* * * * *